US007085305B2

(12) United States Patent
Richardson

(10) Patent No.: US 7,085,305 B2
(45) Date of Patent: Aug. 1, 2006

(54) INDUCTION HEATING APPARATUS AND METHODS OF OPERATION THEREOF

(75) Inventor: John G. Richardson, Idaho Falls, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 22 days.

(21) Appl. No.: 10/926,900

(22) Filed: Aug. 25, 2004

(65) Prior Publication Data

US 2006/0050762 A1 Mar. 9, 2006

(51) Int. Cl.
*H05B 6/22* (2006.01)

(52) U.S. Cl. ..... 373/151; 373/7; 373/138

(58) Field of Classification Search ..... 373/7, 373/138–148, 151–158
See application file for complete search history.

(56) References Cited

U.S. PATENT DOCUMENTS

| | | | | |
|---|---|---|---|---|
| 3,601,717 | A | 8/1971 | Kuecken | |
| 3,686,460 | A | 8/1972 | Lamparter et al. | |
| 4,280,038 | A | 7/1981 | Havas et al. | |
| 4,679,007 | A | 7/1987 | Reese et al. | |
| 4,738,713 | A | 4/1988 | Stickle et al. | |
| 4,866,592 | A | 9/1989 | Fujii et al. | |
| 5,109,389 | A | 4/1992 | Stenzel | |
| 5,165,049 | A | 11/1992 | Rotman | |
| 5,523,631 | A | 6/1996 | Fishman et al. | |
| 5,675,476 | A | 10/1997 | Nostwick | |
| 5,892,790 | A | 4/1999 | Abiko et al. | |
| 5,940,427 | A | 8/1999 | Hurtgen et al. | |
| 6,026,050 | A | 2/2000 | Baker et al. | |
| 6,078,033 | A | 6/2000 | Bowers et al. | |
| 6,144,690 | A | 11/2000 | Kusamichi et al. | |
| 6,163,019 | A | 12/2000 | Green et al. | |
| 6,174,570 | B1 * | 1/2001 | Dambrine et al. | 427/434.7 |
| 6,185,243 | B1 | 2/2001 | Boen et al. | |
| 6,255,635 | B1 | 7/2001 | Thompson et al. | |
| 6,307,875 | B1 * | 10/2001 | Tsuda et al. | 373/142 |
| 6,414,982 | B1 | 7/2002 | Rake et al. | |
| 6,618,426 | B1 * | 9/2003 | Ernst | 373/146 |
| 6,817,212 | B1 | 11/2004 | Romer et al. | |
| 2005/0111518 | A1 * | 5/2005 | Roach et al. | 373/146 |
| 2005/0200442 | A1 * | 9/2005 | Boen et al. | 336/10 |

OTHER PUBLICATIONS

"IGBT Introduction Heating Generator," MSI Automation Inc. <http://www.msiautomation.com/control-panell.html>, Nov. 2003, 2 pages.

* cited by examiner

*Primary Examiner*—Tu Hoang
(74) *Attorney, Agent, or Firm*—TraskBritt, P.C.

(57) ABSTRACT

Methods of operation of an induction melter include providing material within a cooled crucible proximate an inductor. A desired electromagnetic flux skin depth for heating the material within the crucible may be selected, and a frequency of an alternating current for energizing the inductor and for producing the desired skin depth may be selected. The alternating current frequency may be adjusted after energizing the inductor to maintain the desired electromagnetic flux skin depth. The desired skin depth may be substantially maintained as the temperature of the material varies. An induction heating apparatus includes a sensor configured to detect changes in at least one physical characteristic of a material to be heated in a crucible, and a controller configured for selectively varying a frequency of an alternating current for energizing an inductor at least partially in response to changes in the physical characteristic to be detected by the sensor.

37 Claims, 10 Drawing Sheets

INDUCTION HEATING APPARATUS AND METHODS OF OPERATION THEREOF

GOVERNMENT RIGHTS

The United States Government has rights in the following invention pursuant to Contract No. DE-AC07-99ID13727 between the U.S. Department of Energy and Bechtel BWXT Idaho, LLC.

CROSS-REFERENCE TO RELATED APPLICATIONS

This application is related to U.S. application Ser. No. 10/926,899 entitled INDUCTION HEATING APPARATUS, METHODS OF OPERATION THEREOF, AND METHOD FOR INDICATION OF A TEMPERATURE OF A MATERIAL TO BE HEATED THEREWITH, filed on Aug. 25, 2004.

FIELD OF THE INVENTION

Field of the Invention: The present invention relates generally to induction melting apparatus for use in heating at least one material. More particularly, embodiments of the present invention relate to methods of control of induction heating apparatuses.

BACKGROUND OF THE INVENTION

Induction heating apparatuses have been employed for heating a variety of materials without direct contact therewith. For instance, heat treating of metals and melting of materials may be accomplished by induction heating. Further examples of induction heating applications include, without limitation, annealing, bonding, brazing, forging, stress relief, and tempering. Additionally, powder metallurgy applications may relate to heating of a mold or other member which, in turn, heats a powder metallurgy composition to be melted. Metal or other casting applications may also utilize induction heating. Accordingly, as known in the art, induction heating may be useful in various industries and applications.

For instance, one particular application for induction heating relates to treatment and storage of such hazardous materials and is known as "vitrification." Hazardous materials may be vitrified when they are combined with glass forming materials and heated to relatively high temperatures. During vitrification, some of the hazardous constituents, such as hazardous organic compounds, may be destroyed by the high temperatures, or may be recovered as fuels. Other hazardous constituents, which are able to withstand the high temperatures, may form a molten state, which then cools to form a stable vitrified glass. The vitrified glass may demonstrate relatively high stability against chemical and environmental attack as well as a relatively high resistance to leaching, as by water, of the hazardous components contained therein.

One type of apparatus that has proven to be effective to vitrify waste materials is a cold-crucible-induction melter (CCIM). A cold-crucible-induction melter may typically comprise a water-cooled crucible disposed proximate to an induction coil or another inductor; for instance, an induction coil may be formed along a helical path extending about the crucible. Generally, an induction coil may carry alternating electric current that generates associated varying electromagnetic fields for inducing eddy currents within electrically conductive materials encountered thereby. The varying electromagnetic fields generated by the current within an inductor may be described as the "flux" thereof.

Waste may be induction heated directly if it is sufficiently electrically conductive and thus vitrified. However, the waste and glass forming materials used in vitrification systems may be relatively non-electrically conductive at room temperatures. Therefore, an electrically conductive material may be used to initially indirectly heat at least a portion of the waste to a molten state, at which point the waste may become more electrically conductive so that when varying current is conducted through the induction coil, conductive molten waste may be induction heated by way of eddy currents generated therein. Of course, non-electrically-conductive waste materials nearby the electrically conductive molten waste, due to the heat generated therein, may be indirectly heated and thus, melted.

As a further advantage of cold-crucible-induction melter vitrification systems, molten glass within the water-cooled crucible may form a solid layer (skull layer), which inhibits or prevents direct contact of the high temperature molten glass with the interior surface of the crucible. Furthermore, because the crucible itself is cooled with water, in combination with the insulative properties of the skull layer, relatively high-temperature melting may be achieved without being substantially limited by the heat-resistance or melting point of the crucible.

FIG. 1 shows a perspective view of a conventional induction melter 10. Generally, cold-crucible-induction melter 10 includes head assembly 20 affixed to disengagement spool 40 by way of mating lower flange 21 and upper flange 39 of head assembly 20 and disengagement spool 40, respectively. Disengagement spool 40 is affixed to furnace body 30 by way of lower flange 37, which is affixed to the upper flange 31 of the furnace body 30. Head assembly 20 includes off-gas port 12 for removing gasses from the cold-crucible-induction melter 10 during operation, feed port 14 for adding waste material to the cold-crucible-induction melter 10, and view port 15 for observing the conditions within the cold-crucible-induction melter 10. Furnace body 30 may include cooling tubes 22 disposed therearound, which may be supplied with a cooling medium, such as water, by way of inlet 23 and outlet 25 for cooling the crucible (not shown) and also includes bottom drain assembly (not shown) for discharging vitrified waste material from the crucible 56 (FIG. 2A) during operation of the cold-crucible-induction melter 10.

FIG. 2A shows a side cross-sectional view of the cold-crucible-induction melter 10 shown in FIG. 1. More particularly, an induction heating system 90 comprising an induction coil 26, a power source 100, and electrical conductors 110 extending therebetween may be configured for delivering heat to the interior of crucible 56. In further detail, induction heating system 90 may include an induction coil 26 disposed generally about the furnace body 30 of the cold-crucible-induction melter 10 as known in the art (cooling tubes 22 have been omitted from FIGS. 2A–2D for clarity). Both electrical conductors 110 and induction coil 26 may be water-cooled, as known in the art. Power source 100 may comprise a variable-frequency power supply, which is configured for energizing the induction coil 26 with a selectable, alternating electrical current having an amplitude and a frequency wherein at least one of the amplitude and frequency is variable. As known in the art, power source 100 may be operably coupled to or integrally inclusive of a capacitor bank (i.e., a plurality of capacitors) and a transformer, which are configured (separately or in combination)

for tuning (automatically or manually) to the load (i.e., the material to be heated). Each of the plurality of capacitors may be configured to be individually and reversibly electrically coupled to the inductor via the controller.

FIG. 2B shows a side cross-sectional view of the cold-crucible-induction melter 10 shown in FIG. 1 (cooling tubes 22 have been omitted in FIG. 2B for clarity) including granular material 55, which may be disposed within crucible 56. For instance, granular material 55 may comprise hazardous materials and glass forming materials, without limitation. Also, susceptor 120 may be positioned in contact with the granular material 55 and may be configured for heating, in response to energizing induction coil 26, to a temperature sufficient to melt at least a portion of the granular material 55 proximate thereto. For instance, susceptor 120 may comprise graphite and may be shaped as a ring or as otherwise desired. The presence of a susceptor 120 may be necessary to initially melt at least a portion of the granular material 55, because the granular material 55 may not be electrically conductive in a non-molten state. Of course, conversely, if granular material 55 is electrically conductive in a non-molten state, susceptor 120 may be omitted as being unnecessary.

During initial operation of the induction heating system 90 of the cold-crucible-induction melter 10, as shown in FIG. 2B, assuming granular material 55 is not electrically conductive, induction coil 26 carrying an alternating current induces eddy currents within susceptor 120, thus heating susceptor 120. As susceptor 120 increases in temperature, granular material 55 proximate to susceptor 120 may be heated and may form a region of molten material 50 adjacent susceptor 120, as shown in FIG. 2C. Inductive heating by energizing induction coil 26 with an alternating current may then proceed by way of induced electrical currents within the molten material 50, assuming such molten material 50 becomes electrically conductive, in combination with heating of susceptor 120 by way of induced electrical currents therein until substantially the interior of crucible 56 comprises molten material 50, surrounded by skull layer 52, as explained further hereinbelow and shown in FIG. 2D.

Referring to FIG. 2D, granular material 55 may be introduced within cold-crucible-induction melter 10 through feed port 14 and ultimately melted to form molten material 50, which may substantially fill crucible 56. Susceptor 120 (FIGS. 2B and 2C) may be sacrificial, and may substantially oxidize (burn off) or may break into several pieces within molten material 50. As noted previously, crucible 56 may be surrounded by cooling tubes 22 for flowing water or gas through in order to cool the crucible 56 during operation, because the temperatures that may be required to vitrify waste materials may exceed the melting point of the crucible 56. The desired steady-state operational temperature for vitrifying waste material may be about 1200° Celsius. Cooling the crucible 56 during heating of the waste may form a skull layer 52 comprising solidified material (previously molten material 50) disposed along the inner surface of the side wall of the crucible 56. The skull layer 52 may be from a few millimeters to several inches in thickness, and may insulate the molten material 50 within the crucible 56 and also inhibit the molten material 50 from directly contacting and damaging the inner surface of the crucible 56. Skull layer 52 may span a relatively extreme temperature gradient between the cooling water temperature within cooling tubes 22, which may be less than about 100° Celsius, and the molten material 50 temperature, which may be greater than about 1000° Celsius. Of course, the relative thickness of the skull layer 52 may vary depending on the thermal environment of the crucible 56.

Also, cold cap 54, comprising granular material 55 and, possibly, condensed off-gas material, may preferably exist upon the upper surface of molten material 50 thereof under preferred conditions. Cold cap 54 may reduce volatilization of molten material 50 and may also insulate molten material 50. Impact zone 59 indicates a region of cold cap 54 that granular material 55, shown as entering the cold-crucible-induction melter 10 through feedport 14, may fall upon and accumulate. Dust, volatized material, and evolved gases 57 may exit or move upwardly away from the impact zone 59 of cold cap 54 into the plenum volume 200. Ultimately, dust, volatized material, and evolved gases 57 may subsequently condense, deposit, or settle onto cold cap 54, adhere to the inner wall of disengagement spool 40 or head assembly 20, respectively, or exit the plenum volume 200 through offgas port 12.

Induction coils 26 surrounding crucible 56 may be energized with relatively large alternating currents to induce currents within the waste material to be heated. Typically, induction coils 26 may be fabricated from a highly electrically conductive material, such as copper, and are cooled by water or another fluid flowing therein. As known in the art, waste materials, such as radioactive waste or other waste may be combined with glass forming constituents, heated, and thereby vitrified.

Generally, conventional induction heating systems may be configured for heating in response to a temperature set-point. More particularly, conventional induction heating systems may be configured for varying the output power of the power source 100 in relation to the difference between a desired temperature and a measured temperature of the material to be heated. However, while such a temperature feedback control system may be relatively effective in controlling the temperature, it may not be particularly electrically efficient. Put another way, the transmission of electrical power between the induction coil 26 and the material that is heated therewith (e.g., the molten material 50, the susceptor 120, etc.) may be relatively inefficient.

Further, there may be difficulties in obtaining reliable temperature information relating to the molten material 50 that may complicate operation of the cold-crucible-induction melter 10. Therefore, conventional cold-crucible-induction melters may be often controlled manually. For example, conventional cold-crucible-induction melters may be controlled by "feel" or by secondary indications such as so-called "frequency pulling" in relation to the applied frequency of an induction power source 100. Such methods of control may be even more electrically inefficient than temperature feedback methods, and may also promote unintended variances from a desired temperature due to operator errors.

One approach for operating an induction melting furnace for glass (i.e., a cold-crucible-induction melter), disclosed by U.S. Pat. No. 6,185,243 to Boen et al., includes a melting furnace, including a cooled crucible having continuous metal side walls, a partitioned and cooled bottom and at least one induction coil positioned under the bottom of the crucible. The at least one induction coil is disclosed to be the sole heating means for materials within the crucible. The depth of the melting bath contained in the crucible and the excitation frequency of the induction coil are selected so that the depth and half of the inside radius of the crucible are less than the skin thickness of the bath.

In view of the foregoing problems and shortcomings with existing induction heating processing materials and systems, it would be advantageous to provide control methods relating to increased efficiency for operation of cold-crucible-induction melters.

BRIEF SUMMARY OF THE INVENTION

The present invention relates to methods of operation of an induction heating apparatus. Particularly, a crucible having a wall disposed about a longitudinal axis and a bottom extending generally radially inwardly from the wall toward the longitudinal axis may be provided. Further, the walls of the crucible may be cooled and at least one material may be provided within the crucible. An inductor may be provided proximate to the crucible and in operable communication with an induction heating circuit including a power source.

A desired skin depth for heating the at least one material within the crucible may be selected and a frequency of an alternating current for energizing the inductor therewith and for producing an electromagnetic flux exhibiting a desired skin depth within the at least one material may be selected. Finally, the inductor may be energized with the alternating current having the selected frequency. Optionally, the frequency of the alternating current may be selected in response to a difference between a desired skin depth and the indicated skin depth of the electromagnetic flux within the at least one material. Further, additionally or alternatively, the frequency of the alternating current may be selected by selecting a net capacitance magnitude for inclusion within the induction heating circuit.

In one embodiment, the desired skin depth may be selected to be about 38% of a diameter of the at least one material. Such a desired skin depth may substantially maximize the electrical efficiency of inductively heating the at least one material.

In another aspect of the present invention, the at least one material may be heated while substantially maintaining a desired skin depth as the at least one material increases in temperature. More generally, a desired skin depth of the at least one material may be substantially maintained while the temperature thereof varies, without limitation.

For example, a molten material may be provided which substantially fills a crucible of an induction heating apparatus. An inductor may be provided proximate to the crucible and in operable communication with an induction heating circuit, the induction heating circuit including a power source. Additionally, a desired skin depth may be substantially maintained within the molten material, upon energizing the inductor, as the temperature of the molten material varies.

The present invention also relates to an induction heating apparatus. More specifically, an induction heating apparatus of the present invention may include a crucible and a cooling structure disposed about the crucible for cooling thereof. In addition, an inductor may be disposed proximate the crucible and a variable-frequency power supply having an electrical output may be operably coupled to the inductor and configured for delivering an alternating current therethrough. Further, a controller may be configured for selecting a frequency of the alternating current delivered from the variable-frequency power supply and for energizing the inductor and the frequency may be selected for producing an electromagnetic flux exhibiting a desired electromagnetic flux skin depth within an anticipated at least one material positioned within the crucible.

BRIEF DESCRIPTION OF THE DRAWINGS

While the specification concludes with claims particularly pointing out and distinctly claiming that which is regarded as the present invention, the advantages of this invention can be more readily ascertained from the following description of the invention when read in conjunction with the accompanying drawings in which:

DETAILED DESCRIPTION OF THE INVENTION

The present invention relates to an induction heating apparatus and methods of operation thereof. For example, one particular type of induction heating apparatus may be a cold-crucible-induction melter. While the following discussion relates to a cold-crucible-induction melter for melting at least one material, the present invention is not so limited. Rather, the present invention relates to induction heating apparatus for use as known in the art, without limitation.

In one aspect of the invention, the induction system 90 comprising a portion of the cold-crucible-induction melter 10 may be controlled or operated in relation to a so-called "skin depth" of the material being heated, as described in further detail hereinbelow. Such a method of operation may improve the electrical efficiency compared to conventional methods for controlling an induction heating process, since electrical efficiency between the alternating current carried by the induction coil 26 and the eddy currents induced therewith for heating a material may be a function of the skin depth or penetration depth of the electromagnetic flux generated by the alternating current passing through the induction coil 26 and penetrating into the material being heated. Therefore, in accordance with the present invention, the induction system 90 of the cold-crucible-induction melter 10 may be operated for maintaining or regulating a desired skin depth of an electromagnetic flux in relation to at least one material disposed within the crucible, during heating thereof.

Generally, the skin depth of an electromagnetic flux may be defined as the depth to which eddy-currents are induced within a material heated by electromagnetic flux. The theoretical depth of penetration or skin depth ($d_0$) within a material to which an electromagnetic wave travels to is defined to be the depth at which the electromagnetic field is reduced to 1/e or approximately 37 percent of its value at the surface. In the case of induction heating, the theoretical skin depth of the varying electromagnetic fields and the resulting eddy currents may be computed by the following equation:

$$d_0 = 500\sqrt{\frac{\rho}{\mu f}} \quad \text{Equation 1}$$

Wherein:

$d_0$ is the skin depth in centimeters;

ρ is the electrical resistivity of the material in Ohm-centimeters;

μ is the magnetic permeability of the material in Henrys per centimeter; and f is the frequency of oscillation of the electromagnetic wave in Hertz.

Since the frequency of the oscillation of the electromagnetic wave is the only non-material dependent variable, influencing the skin depth $d_0$ may be accomplished by varying the frequency of the alternating current communicated to the induction coil.

Figure 3:
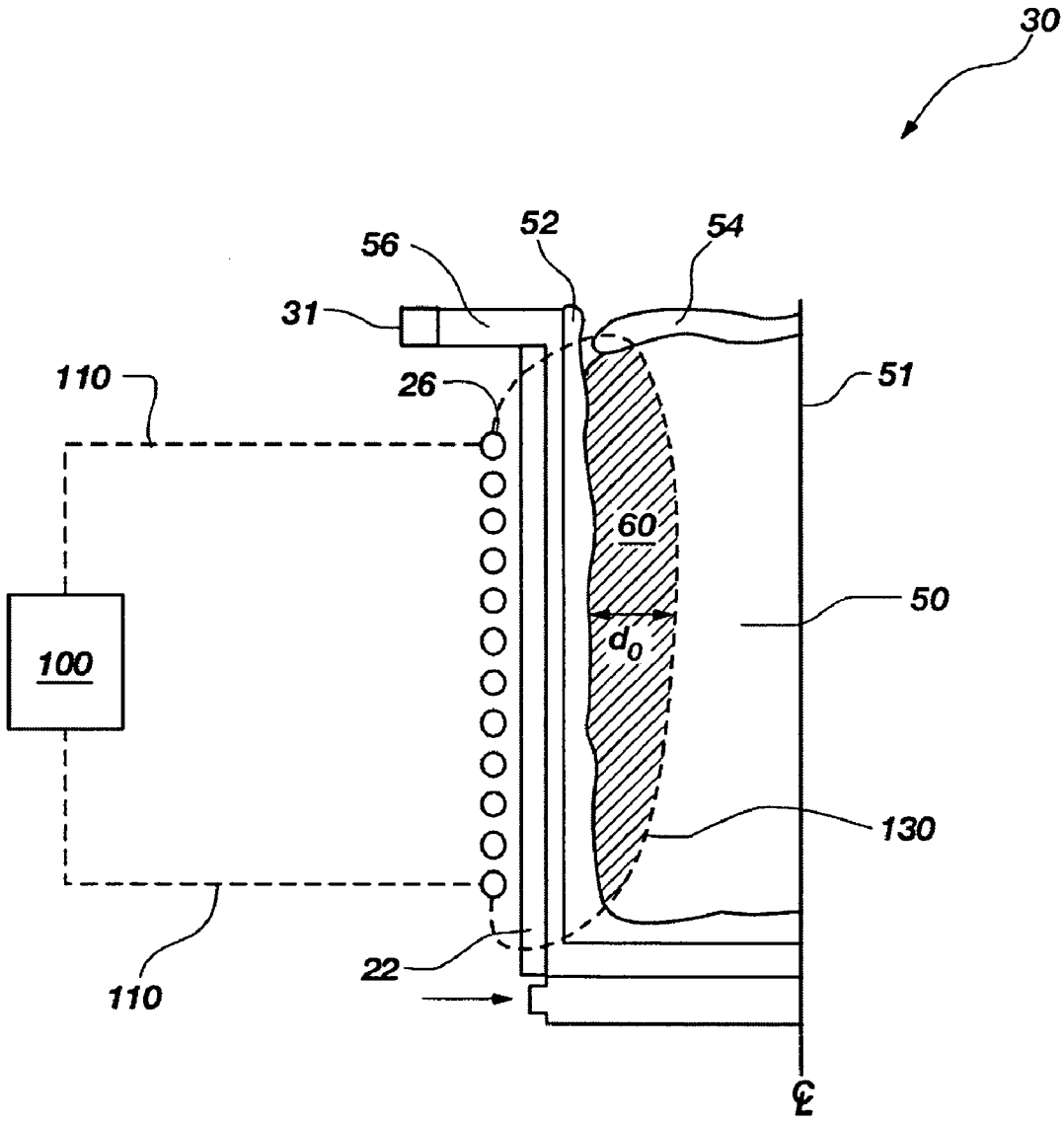
FIG. 3 illustrates a schematic side cross-sectional view of a furnace body during operation.

FIG. 3 shows a partial schematic side cross-sectional view of a furnace body 30 during an operation, wherein crucible 56 is disposed about longitudinal axis 51 and cooling tubes 22 are positioned thereabout. Explaining further, for example, where molten material 50 forms the primary contents of the crucible 56, an indication of the temperature of a region 60 of the molten material 50 may be indicated by selecting the operational parameters of the power source 100 so as to generate a flux having an anticipated skin depth $d_0$. Skin depth $d_0$ is illustrated by the overlap between the electromagnetic flux envelope 130 (i.e., the extent to which the electromagnetic flux penetrates molten material 50) and the molten material 50. It may be appreciated, however, that such a depiction is merely illustrative, and an actual flux field may continuously decay (e.g., exponentially) with distance from the induction coil 26.

It should also be understood that while electromagnetic flux envelope 130 is depicted as having a relatively well-behaved shape, the actual shape and size of a flux field may be highly dependent on the particular configuration of the induction coil 26 and the materials and properties thereof proximate to the induction coil 26. Thus, electromagnetic flux envelope 130 is merely a representative, schematic depiction of the induction heating process and should not be construed as limiting of the present invention.

It should further be noted that while the electromagnetic flux envelope 130 may be described and may be mathematically treated as substantially symmetric, substantially cylindrical, or both substantially symmetric and substantially cylindrical, the distribution of electrical heating within molten material 50 by way of an induction coil 26 may be uneven in nature, depending on the geometry and material properties of the molten material 50, the proximity of the induction coil 26 to the molten material 50, the geometry of the induction coil 26, or other environmental conditions that may influence the electromagnetic flux of the induction coil 26 in relation to the molten material 50. The present invention contemplates that such unevenness may be modeled, predicted, or otherwise compensated for so as to increase the efficiency of the induction heating process.

Regarding induction power source 100, induction power source 100 may be configured for communicating an alternating current to induction coil 26 via an induction heating circuit. "Induction heating circuit," as used herein, refers to the electrical circuit through which the alternating current for energizing the induction coil 26 passes. Induction power source 100 may comprise an induction heating power supply as known in the art, such as, for instance, a generator-type power supply or a solid state power supply. Further, induction power source 100 may include electrical transformers, inductors, or capacitors as known in the art and configured for supplying alternating current to the induction coil 26. According to the present invention, the alternating current may be selectively tailored to adjust the skin depth within the limits of the power source 100.

In addition, approximation of the induction power source 100, induction coil 26, net capacitance, and net inductance may yield a solution for the resonant frequency of the current within the induction heating circuit. The frequency (in Hertz) of oscillation of the current may be calculated by the following equation:

$$f = \frac{1}{2\pi\sqrt{LC}} \quad \text{Equation 1}$$

Wherein:

L is the net electrical inductance of the circuit; and

C is the net electrical capacitance of the circuit.

Thus, as may be appreciated by consideration of the above-equation, by adjusting or altering the capacitance of the induction heating circuit, the frequency of the alternating current communicated through the induction coil 26 may be changed. Accordingly, one approach for changing the electrical capacitance of the induction heating circuit may be to include at least one variable capacitor therein and to alter the capacitance of the at least one variable capacitor. For instance, one commercially available variable capacitor may comprise a vacuum capacitor having an adjustable capacitance magnitude of the type sold by Omnicor, Inc. of Foster City, Calif.

Alternatively, another approach for selecting the net capacitance of the induction heating circuit may be to electrically include or exclude one or more selected capacitors, each having a fixed capacitance magnitude, with respect to the induction heating circuit. Such a configuration may be possible by providing a so-called "bank" of capacitors, of which one or more thereof may be selectively included in or excluded from the induction heating circuit. Put another way, each of the plurality of capacitors may be configured to be individually and reversibly electrically coupled to the inductor. Conventional induction heating systems may include a bank of capacitors that are typically manually used to tune the induction heating circuit to the load for delivering a selected magnitude of power to a material being heated therewith. Since a commercially available capacitor bank may comprise a plurality of capacitors, each capacitor having a fixed magnitude of capacitance, the degree of variation of the capacitance may be limited by the number of capacitors, their respective fixed magnitude of capacitance, and combinations thereof. Accordingly, the capacitance of a bank of capacitors may be selected so as to substantially correspond with a desired or selected net capacitance, but may not precisely equal the selected capacitance.

In addition, since a skin depth magnitude may be related to magnetic permeability and electrical resistance of the material being inductively heated, measurements or at least indications of the respective magnitude of these properties may be desirable for implementing a control or regulation algorithm wherein the alternating current communicated through the induction coil 26 is selected based substantially on a skin depth. However, one consideration may be that electrical resistivity, magnetic permeability, or both, may vary widely with temperature; thus, it may be desirable to indicate and adjust the alternating current with respect to material variations that influence the skin depth of an electromagnetic flux therein.

Specifically, a metal belonging to the ferromagnetic class (i.e., iron, cobalt, nickel, etc.) may exhibit a varying magnetic permeability. However, for other materials, magnetic permeability may be substantially constant. For instance, a paramagnetic material may have a magnetic permeability that is a little greater than 1 while a diamagnetic material may have a magnetic permeability that is a little less than 1. Accordingly, the variability of a magnetic permeability of a material for a given range of temperature may be estimated or, alternatively, may be assumed constant for purposes of calculating a skin depth. In the particular case of the glass-forming materials used in waste vitrification, the magnetic permeability thereof may be assumed to be substantially constant.

With respect to the electrical resistance of a material within the influence of an electromagnetic flux field, it may be desirable to measure the electrical resistance thereof. Particularly, it may be desirable, for instance, to measure the electrical resistivity of molten material 50, as one variable of interest in determining the skin depth of an electromagnetic flux field therein. For example, the resistivity of molten material 50 may be measured by a so-called "four-point" or Schlumberger resistivity measurement technique.

Figure 4:
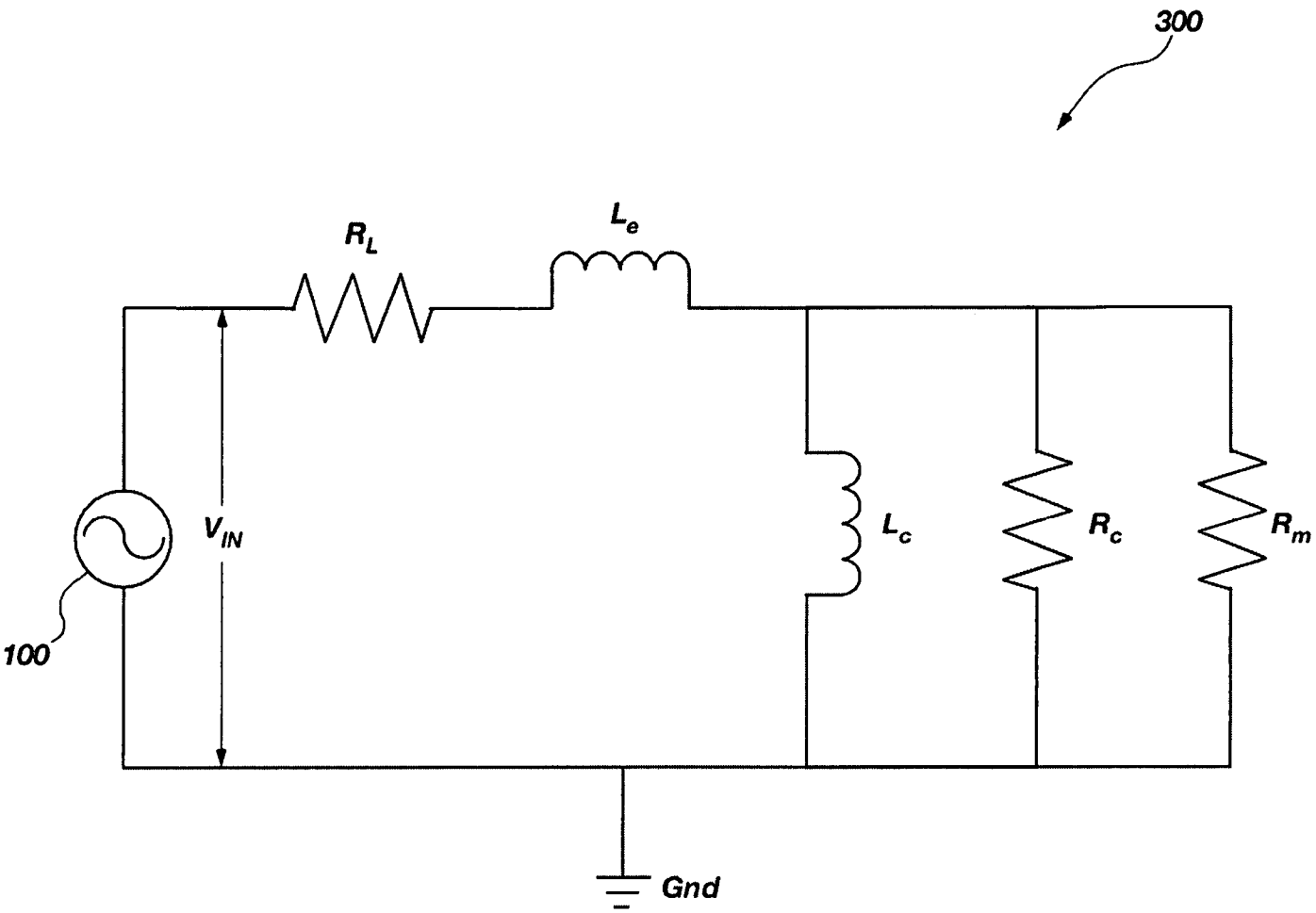
FIG. 4 illustrates a schematic induction heating circuit model.

Alternatively, the resistivity of the molten material 50 may be estimated or indicated. For example, an induction heating circuit model 300 of an induction heating circuit is shown in FIG. 4 and includes electrical representations of induction power source 100, induction coil 26, molten material 50, and various other electrical properties that may affect the electrical current passing through the induction coil 26. According to the present invention, the induction heating circuit model 300 may be analyzed, and a solution for the resistance of the molten material 50 may be obtained, as explained below.

For instance, the induction heating system 90 and molten material 50 may be approximated or simulated as shown by the induction heating circuit model 300 shown in FIG. 4, where the power source 100 supplies $V_{IN}$ to the induction heating circuit model 300. The induction heating circuit model 300 comprises a wiring resistance $R_L$, a leakage inductance $L_E$, a coil inductance $L_C$, a coil resistance $R_C$, and a melt resistance $R_M$.

Further, by Ohm's law, $$\frac{V_{IN}}{I_{IN}} = Z_{IN} = \alpha + j\beta \qquad \text{Equation 2}$$

Wherein:

$V_{IN}$ is the voltage applied to the induction heating circuit model 300;

$I_{IN}$ is the current flowing through the induction heating circuit model 300;

$Z_{IN}$ is the impedance of the induction heating circuit model 300;

$\alpha$ is the real component of the impedance of the induction heating circuit model 300; and $j\beta$ is the imaginary component of the impedance of the induction heating circuit model 300.

Also, $$Z_{IN} = R_W + j\omega L_E + \frac{j\omega L_C \frac{R_M R_C}{R_M + R_C}}{j\omega L_C + \frac{R_M R_C}{R_M + R_C}} \qquad \text{Equation 3}$$

Wherein:

$R_M$ is the electrical resistance of the molten material 50;

$R_C$ is the electrical resistance of the induction coil 26;

$R_W$ is the electrical resistance of the wiring from the power source 100 to the induction coil 26;

$L_C$ is the impedance of the induction coil 26; and $L_E$ is the electrical inductance of the wiring from the power source 100 to the induction coil 26.

Setting Equation 3 equal to Equation 4 and then solving for both the imaginary component and the real component gives respective solutions for $R_M$. Thus, $R_M$ may be determined by substitution of measurements for the values of the imaginary component and the real component as well as the electrical resistance values and electrical inductance values that appear in Equation 4.

It should be noted that both FIG. 4 and the above analysis pertaining to a mathematical solution for $R_M$ is merely one example. Thus, such analytic approaches may be substantially varied, depending upon the specific details of the underlying induction heating circuit model 300 that are employed. Accordingly, the present invention contemplates that modifications, additions, simplifications, or other variations of the induction heating circuit model 300 shown in FIG. 4 may be employed by the present invention and associated analytic examination thereof is encompassed by the present invention, without limitation.

Thus, as discussed above, the variables for ascertaining a skin depth $d_0$ may be indicated, estimated, or otherwise obtained and accordingly, a skin depth $d_0$ may be obtained. Further, once a skin depth measurement, calculation, or indication may be obtained, a method of the present invention may be practiced, as described hereinbelow.

In one method of control or regulation of an induction heating system 90 of a cold-crucible-induction melter 10 of the present invention, a desired skin depth may be selected and a frequency of the alternating current communicated from the power source 100 through the induction coil 26 for producing the desired skin depth may be selected. Of course, the induction coil 26 may be energized with the alternating current having the selected frequency. Optionally, a difference between the desired skin depth set point and the indicated skin depth may be used to determine the selected frequency.

Figure 1:
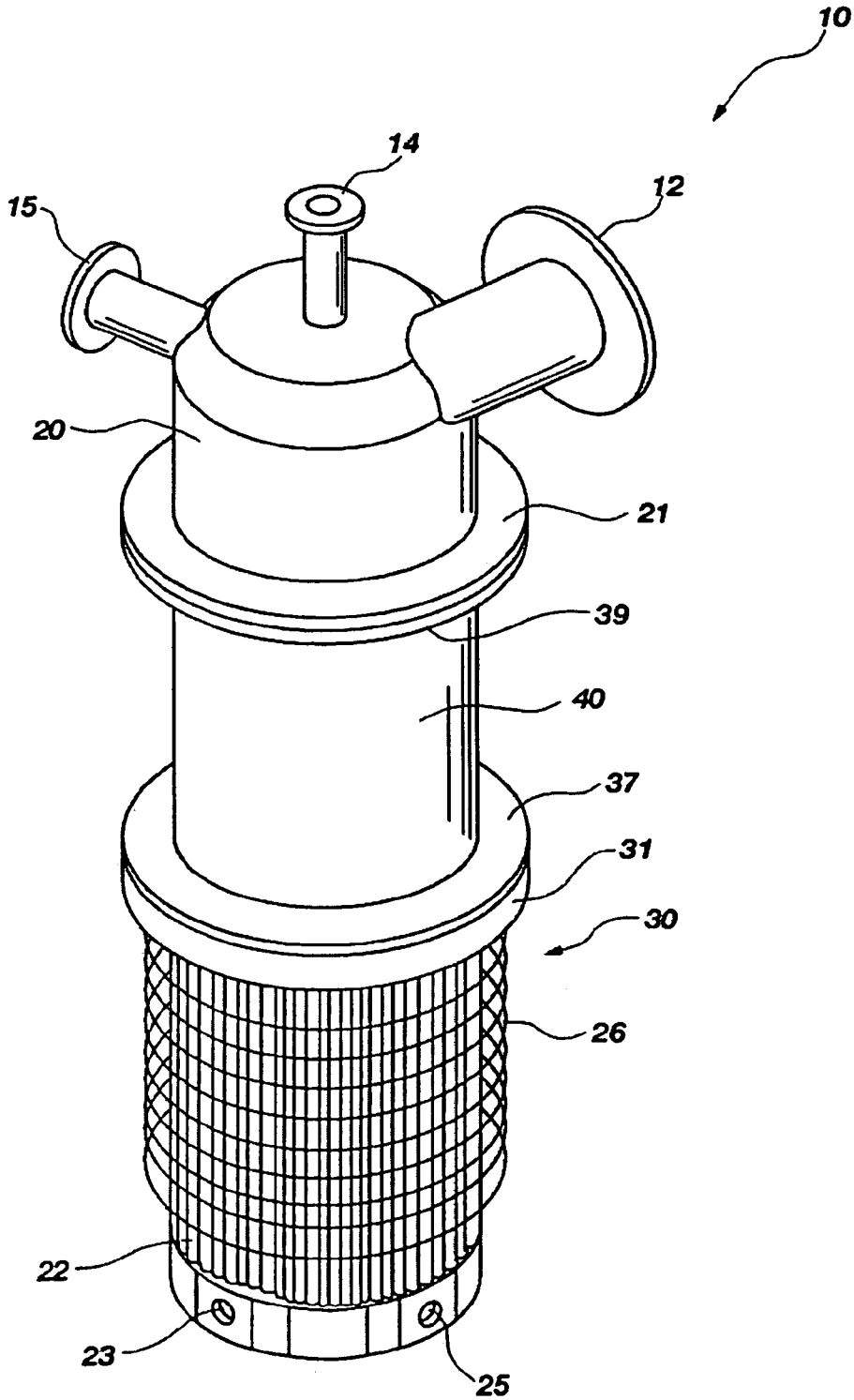
FIG. 1 PRIOR ART
FIG. 1 illustrates a perspective view of a cold-crucible-induction melter.
Figure 2A:
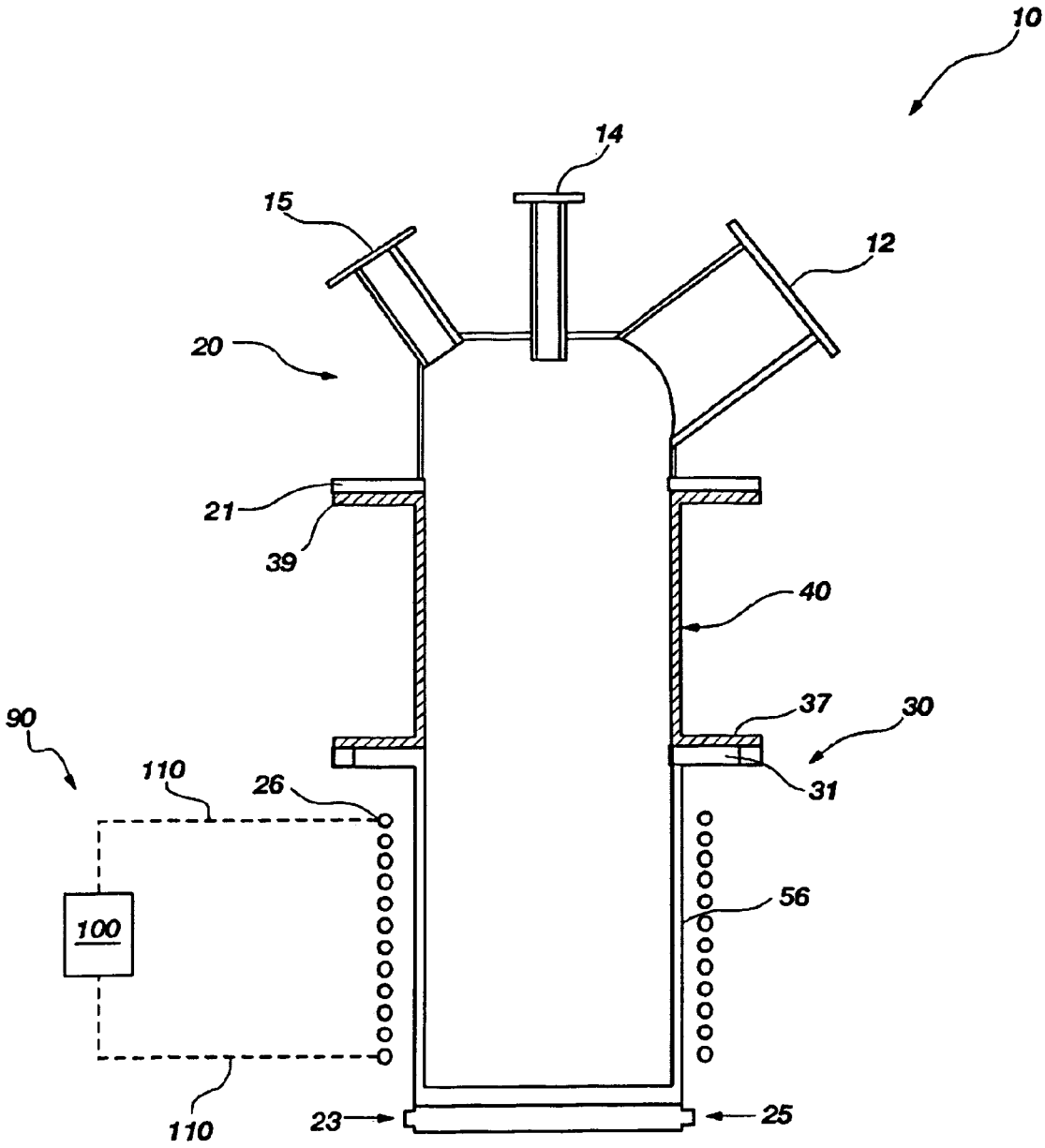
FIG. 2A PRIOR ART
FIG. 2A illustrates a schematic side cross-sectional view of the cold-crucible-induction melter shown in FIG. 1.
Figure 2B:
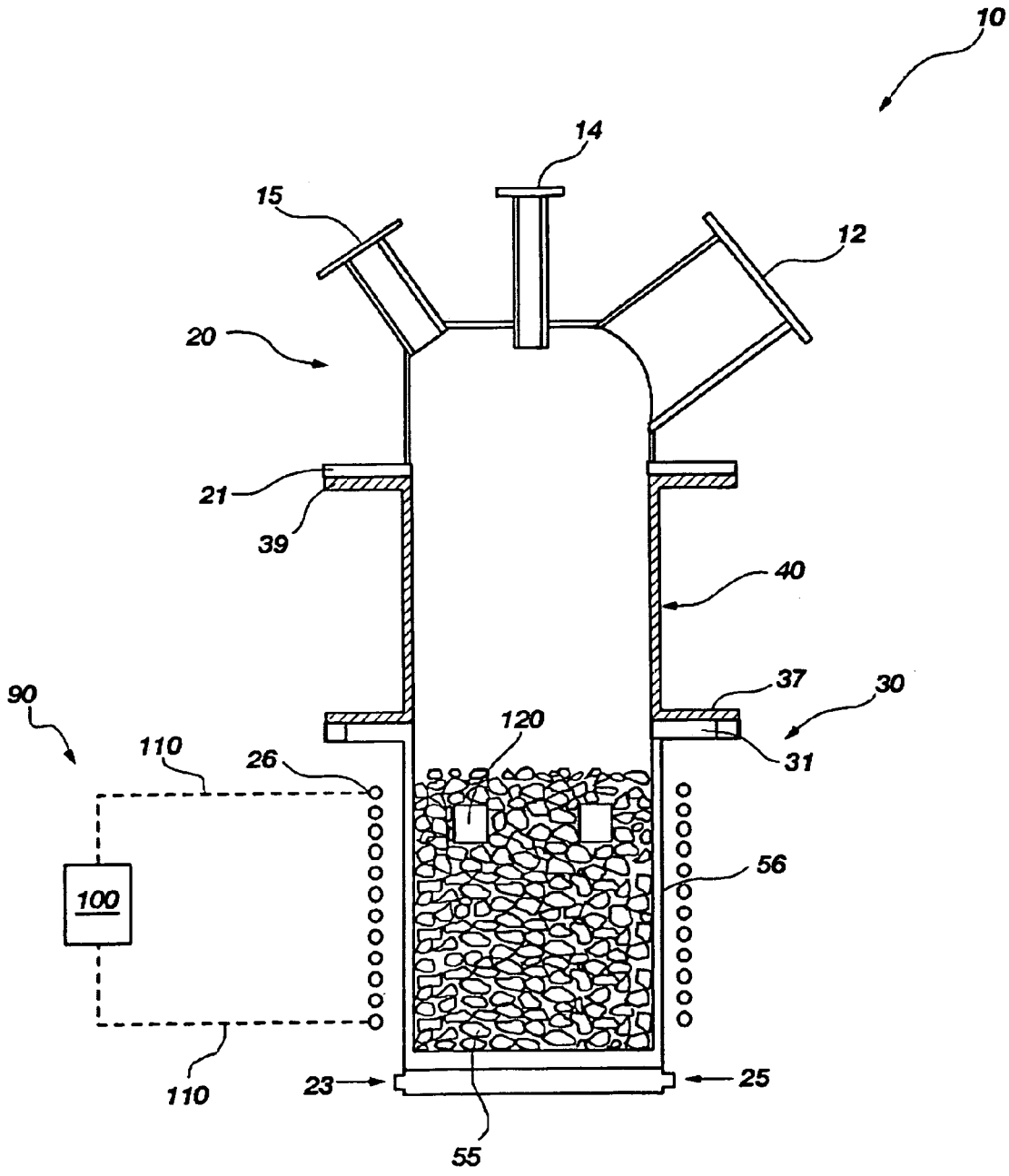
FIG. 2B PRIOR ART
FIG. 2B illustrates a schematic side cross-sectional view of the cold-crucible-induction melter shown in FIG. 1 during operation thereof.
Figure 2C:
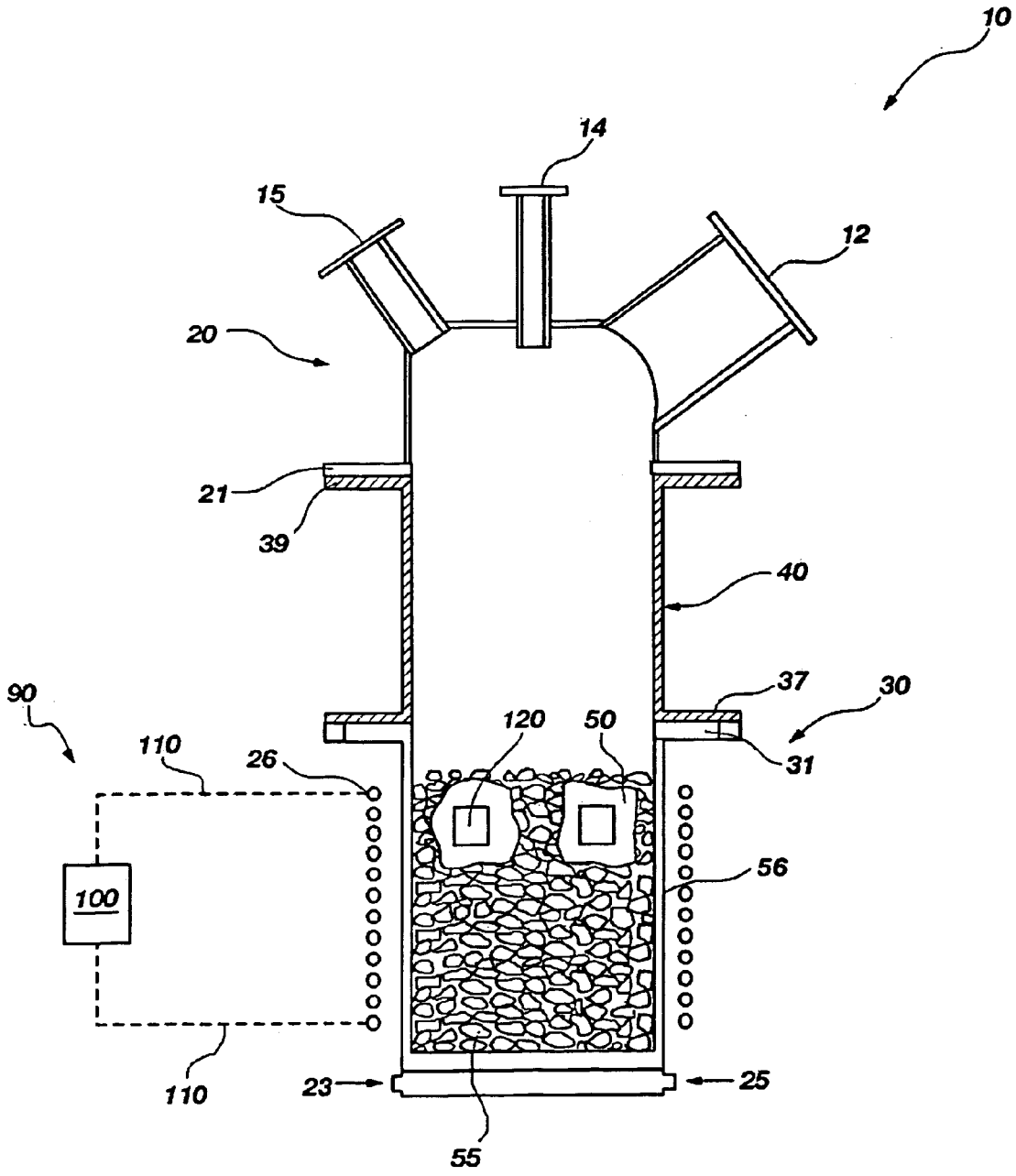
FIG. 2C PRIOR ART
FIG. 2C illustrates a schematic side cross-sectional view of the cold-crucible-induction melter shown in FIG. 1 during operation thereof.
Figure 2D:
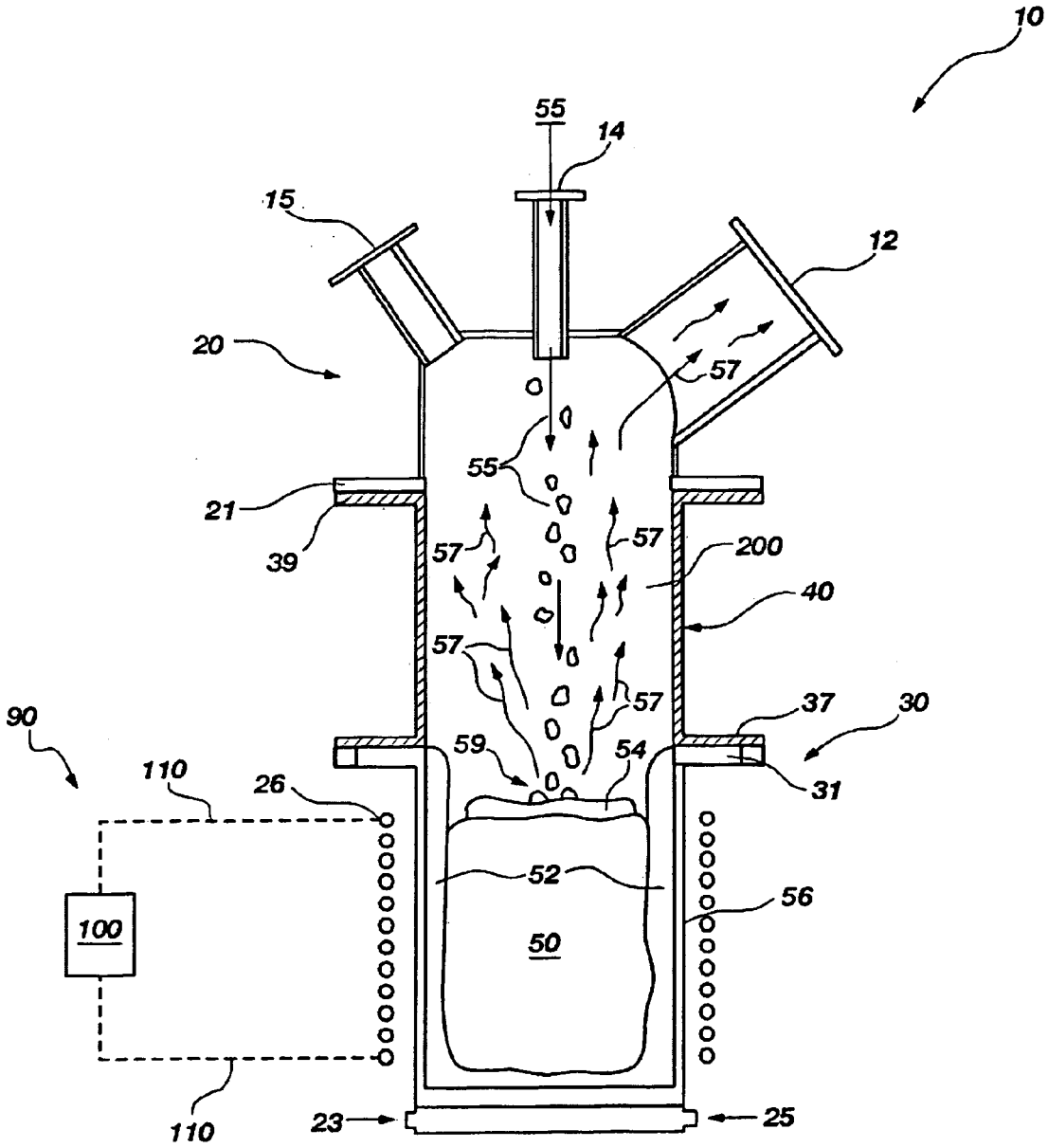
FIG. 2D PRIOR ART
FIG. 2D illustrates a schematic side cross-sectional view of the cold-crucible-induction melter shown in FIG. 1 during operation thereof.

The following discussion relates to the operational conditions illustrated in FIGS. 2D and 3, where the molten material 50 forms the primary contents of (i.e., substantially fills) crucible 56. Thus, the following discussion is directed toward heating of the molten material 50 via induction heating system 90, while controlling or maintaining a desired skin depth, via selecting appropriate frequencies of an alternating current for energizing the induction coil 26. Optionally, the frequency of an alternating current may be selected so as to minimize the variance between a desired skin depth and a measured or indicated skin depth of the electromagnetic flux in relation to the molten material 50. Of course, such an approach may be utilized for inductively heating more than one material, such as, for instance, molten material 50 and a susceptor 120.

In one approach of the present invention for controlling induction heating system 90, an indicated skin depth may be provided for a user thereof, which may be compared to a desired skin depth set point and manual adjustment of the frequency of the alternating current to the induction coil 26, when energized, may be performed for minimizing the variance or difference between the skin depth set point and the measured skin depth. The decision to energize the induction coil 26 may also be left to a user or may be automatically performed by a controller that compares the error signal between a desired temperature set point and a measured or calculated temperature.

However, while a manual approach for adjusting the skin depth of the electromagnetic flux field may be satisfactory in some situations, it may be preferable to implement a so-called "closed loop" or automatic feedback control system, which may be configured to adjust the frequency of the alternating current to the induction coil 26 in response to a variance between the skin depth set point and the measured skin depth, without substantial user involvement.

For instance, a computerized data acquisition system or other measurement or control system may be employed to calculate substantially "real-time" values for the skin depth of a material within the influence of the electromagnetic flux of induction coil 26. Extrapolating further, the ability to calculate skin depth may provide a feedback signal for controlling the alternating current supplied from the induction power source 100 for energizing the induction coil 26. Thus, if material properties, such as resistance, change during heating thereof, the frequency of the alternating current may be adjusted for maintaining a desired skin depth therein.

Figure 5:
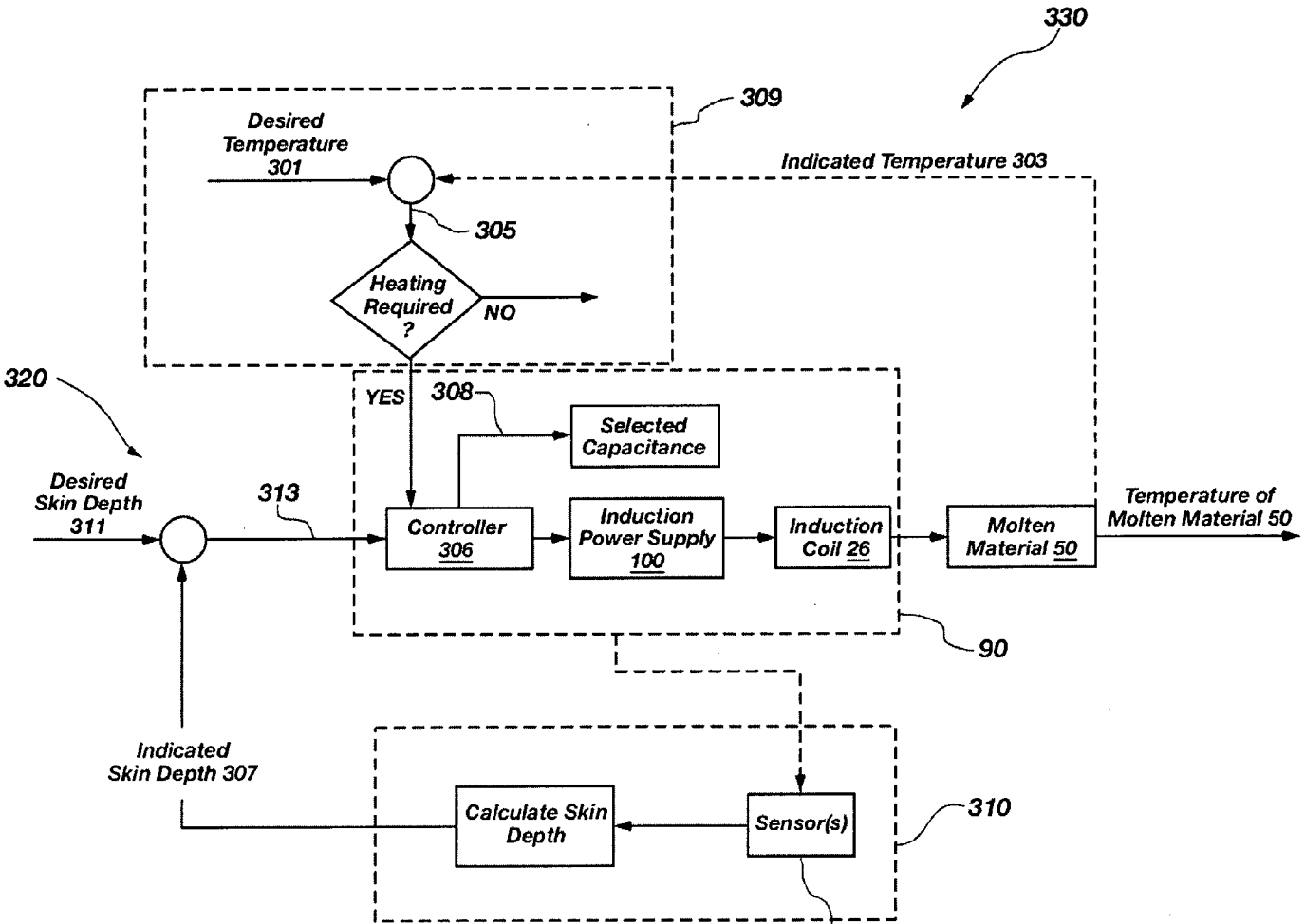
FIG. 5 illustrates a schematic representation of a feedback control loop according to the present invention.

As shown in FIG. 5, a schematic representation of a feedback control loop 330 is shown. The feedback control loop 330 generally comprises a heating feedback control loop 309 as well as a skin depth feedback control loop 320. Overall, it should be noted that the decision to energize or refrain from energizing the induction coil 26 is not particularly pertinent to the present invention. However, heating feedback control loop 309 may be configured for selectively energizing the power source 100 in cooperation with the skin depth feedback control loop 320.

Optionally, the resistivity of the molten material 50 may be correlated to the temperature of the molten material 50, if the relationship therebetween is known or may be otherwise predicted or estimated. Alternatively, the temperature of the molten material 50 may be measured or indicated by a thermocouple, an optical pyrometer, or another temperature measurement device as known in the art.

The present invention relates to a method based on a construct that if the induction coil 26 is energized, the frequency of the alternating current flowing therein should be selected so as to generate, maintain, or endeavor toward a desired skin depth. Such an operational method may be used for maintaining a relatively high electrical efficiency, or as otherwise desired.

Thus, a heating feedback control loop 309 may be provided that is configured to control the temperature of the at least one material (i.e., determine or control whether or not the induction coil 26 should be energized). For instance, a desired temperature 301 may be compared to an indicated temperature 303. The difference between the desired temperature 301 and the indicated temperature 303 may be used as a so-called error signal 305 to form a basis for a control decision of whether or not to energize the induction coil 26.

In further detail, controller 306 may comprise an apparatus that selects a capacitance magnitude for inclusion within an induction heating circuit for supplying an alternating current for energizing the induction coil 26. As explained above, selection of a desired a capacitance value for inclusion within the induction heating circuit influences the frequency of the alternating current therein; therefore, the skin depth of the electromagnetic flux of the induction coil 26 within the material to be heated may be altered by changing the frequency of the alternating current passing therethrough. Thus, a difference (i.e., error signal 313) between the desired skin depth 311 and the indicated skin depth 307 may generate a control signal 308 via controller 306, which is used to select a magnitude of capacitance that reduces or minimizes the difference between the desired skin depth 311 and the indicated skin depth 307 by altering the frequency of the alternating current supplied to the induction coil 26 by induction power source 100.

Controller 306 may implement a so-called proportional, integral, and derivative type control algorithm for regulation or maintaining of the desired skin depth 311. Of course, other control approaches, such as optimal control, neural networks, or adaptive control methodologies may be utilized, without limitation. Furthermore, controller 306 may implement logic, timers, limits, alarms, or other control or safety devices or methodologies as known in the art or as otherwise desired. Thus, the control signal 308 may be developed in consideration of any number of inputs, measurements, or indications.

As described above, indicated skin depth 307 may be calculated by measurement of one or more electrical properties or operational conditions related to induction heating system 90. Sensor(s) 302 may measure voltage, resistance, inductance, capacitance, or other electrical parameters relating to the induction heating circuit.

The process and implementation for supplying the indicated skin depth 307 may be termed an "estimator" 310, because control or regulation of the induction power source 100 is performed via an indirect measurement of a skin depth $d_O$ of the electromagnetic flux within the molten material 50. Put another way, the indicated skin depth 307 may be determined by indirect indication of a skin depth $d_O$ within molten material 50.

It should be appreciated that if a desired temperature 301 is substantially attained, the material properties of molten material 50 may become substantially constant or steady state. In such a situation, assuming that the desired skin depth 311 is held constant, the frequency of the alternating current supplied to the induction coil 26 may be substantially constant.

Thus, the present invention contemplates a method including substantially maintaining the desired skin depth while maintaining a substantially constant temperature of the molten material. However, it should be recognized that the desired skin depth may be substantially maintained despite variations in the temperature of molten material 50. Accordingly, the present invention contemplates inductively heating the molten material via the induction coil 26 while substantially maintaining a desired skin depth within the molten material 50 as the temperature thereof varies or changes.

In such a situation, or as otherwise desired, heating feedback loop 309 may implement a time on, time off control approach (e.g., similar to pulse width modulation as used for varying the power of a direct current motor). In such an approach, a substantially constant input, may be energized for a selected percentage of time and may be turned off for the remaining percentage of time. By adjusting the ratio of the on time and the off time, relatively refined control of the power delivered by the induction coil 26 may be effected.

In another aspect of the present invention, configuring the skin depth to substantially correspond with a desired position or region of the molten material 50 or, more generally, at least one material, disposed within the crucible 56 may result in improved electrical efficiency in heating thereof. For instance, a skin depth of the electromagnetic flux of the induction coil 26 of between about ¼ to ⅖ of the diameter of the molten material 50 may be relatively efficient. Preferably, a skin depth set point of about 38% of a molten material 50 diameter may provide a maximum level of electrical efficiency of inductive heating of the molten material 50 therewithin.

Extrapolating further, the net capacitance within the induction heating circuit for producing a skin depth that maximizes the electrical efficiency of induction heating circuit may be calculated by substituting 38% of the diameter of a material to be heated for skin depth $d_o$ in Equation 1. Setting Equation 1 equal to 38% of the diameter of the molten material yields:

$$.38D = 500\sqrt{\frac{\rho}{\mu f}} \qquad \text{Equation 5}$$

Wherein:

D is the diameter of a material being heated.

Then, solving for f gives:

$$f = 1.73 \cdot 10^8 \frac{\rho}{\mu D^2} \qquad \text{Equation 6}$$

Then substituting Equation 2 for f in Equation 7 gives:

$$\frac{1}{2\pi\sqrt{LC}} = 1.73 \cdot 10^8 \frac{\rho}{\mu D^2} \qquad \text{Equation 7}$$

Further, solving for C yields:

$$C = 8.5 \cdot 10^{-19} \frac{D^4}{L} \frac{\mu^2}{\rho^2} \qquad \text{Equation 8}$$

Thus, a desired net capacitance C of the induction heating circuit for which the skin flux may substantially correspond to about 38% of the diameter of the molten material may be calculated by Equation 9. Thus, the net capacitance C of the induction heating circuit may be selected to substantially correspond to the calculated net capacitance C as calculated in Equation 9 by way of the feedback control loop illustrated in FIG. 5. Such a method of control of induction heating source 100 may be relatively electrically efficient for heating of at least one material within crucible 56, such as, for instance, molten material 50. Of course, it should be recognized that additional electrical elements or behavior such as second-order effects, additional resistances, capacitors, inductors, etc., may be considered in calculation of a desired net capacitance. Put another way, the present invention contemplates that improvements or modifications of the above-calculation of a desired net capacitance may be calculated or otherwise considered, without limitation.

While the method of the present invention may be particularly suited for controlling the output of induction power source 100 during an operational regime illustrated by FIG. 2D, the present invention is not so limited. Rather, the present invention contemplates that methods that select an alternating current for energizing the induction coil 26 based upon a desired skin depth may be utilized during any operational regime of the cold-crucible-induction melter 10, without limitation.

Figure 6:
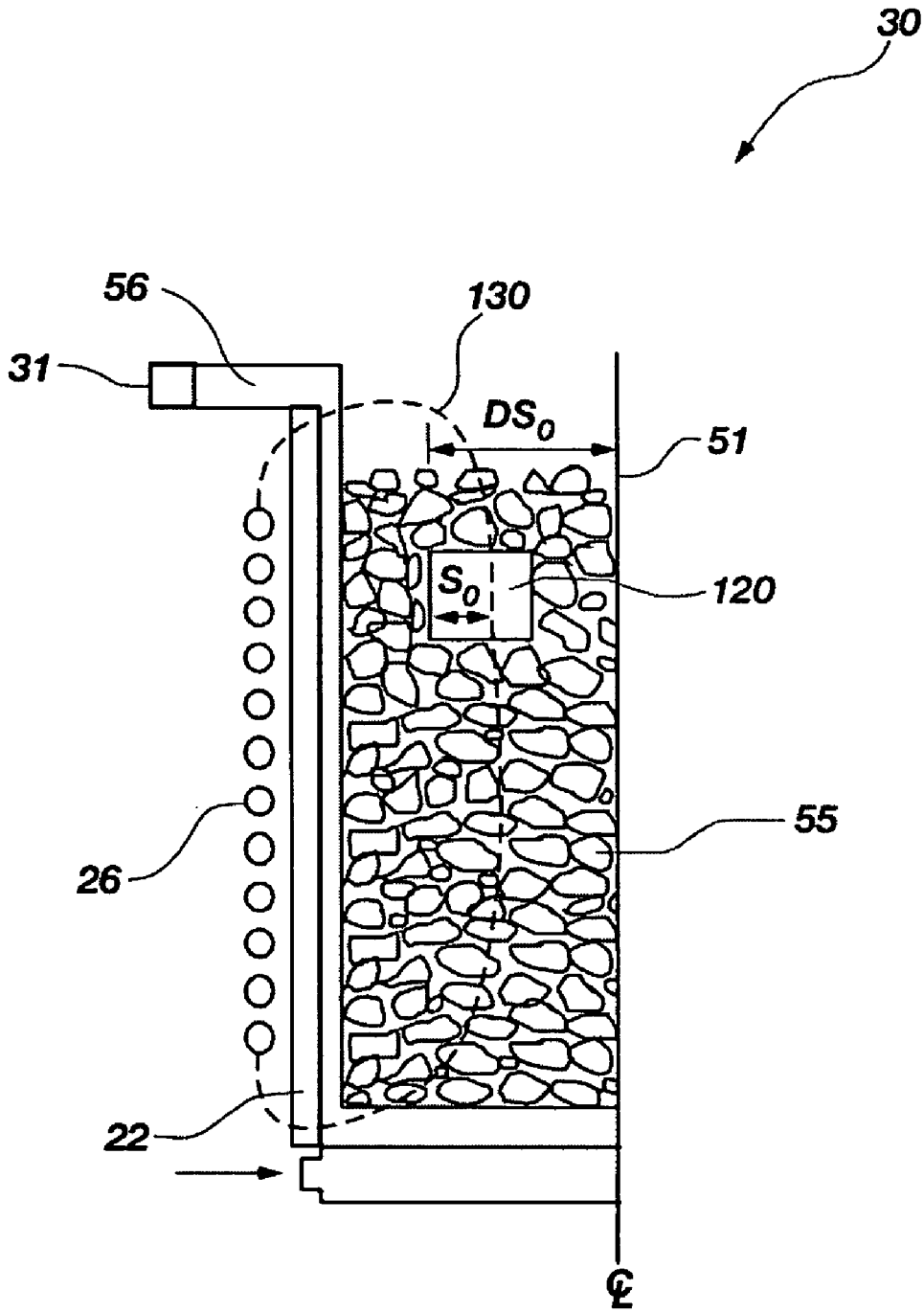
FIG. 6 illustrates an enlarged, schematic, partial side cross-sectional view of the cold-crucible-induction melter shown in FIG. 2B.

For instance, as shown in FIG. 6, which shows a side cross-sectional view of the operational regime depicted in FIG. 2B, electromagnetic flux envelope 130 may be tailored, by adjusting the frequency of the alternating current that may be communicated through the induction coil 26, for heating susceptor 120.

As shown in FIG. 6, skin depth $s_0$ may be selected for heating the susceptor 120 efficiently. For instance, a skin depth $s_0$ of the electromagnetic flux of between about ¼ to ⅖ of the outer diameter $Ds_0$ of the susceptor 120 may be relatively efficient for heating thereof. An optimal relationship between the skin depth and a particular susceptor 120 may be calculated or derived. Such a skin depth may be calculated for substantially maximizing the electrical efficiency of induction heating between induction coil 26 and the susceptor 120. Properties of the susceptor 120, such as electrical resistance and magnetic permeability, may be known before induction heating or may be measured during operation. Alternatively, such properties may be estimated based on predictive modeling.

As may be appreciated from the above discussion, in a further extension of the present invention, control over the alternating current within an induction heating circuit may be selected in response to a desired skin depth during an operational regime depicted by FIG. 2C, where both the susceptor 120 and the molten material 50 may be heated in response to the electromagnetic flux of induction coil 26.

Since skin depth is a characteristic that is material dependent, if there is more than one distinct material having magnetic permeability and electrical resistance, the skin depth related to each distinct material may be different. Accordingly, the present invention contemplates consideration of one or more skin depths in selection of the characteristics of alternating current communicated through the induction coil 26. Of course, it is recognized that the skin depth within each distinct material may be related to one another, because the alternating current communicated through the induction coil 26 may generate an electromagnetic flux, which influences each of a plurality of distinct materials. Thus, in one aspect of the present invention, generally, the frequency of the alternating current communicated through the induction coil 26 may be selected in relation to more than one skin depths within different materials, respectively.

Figure 7:
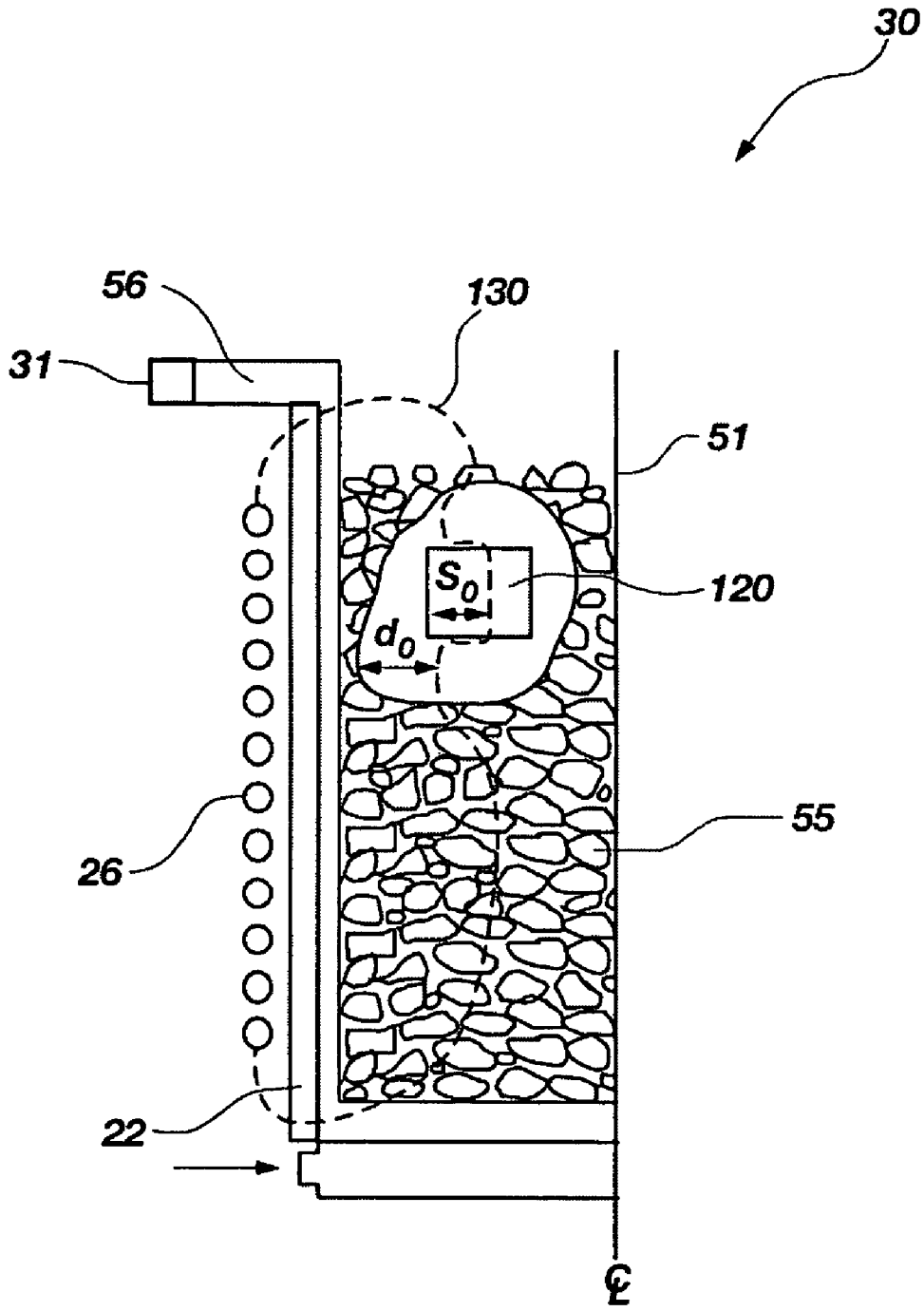
FIG. 7 illustrates an enlarged, schematic, partial side cross-sectional view of the cold-crucible-induction melter shown in FIG. 2C.

For instance, more than one skin depth may be considered in controlling the alternating current flowing through the induction coil 26. For instance, as shown in FIG. 7, once at least a portion of the granular material 55 becomes molten and forms molten material 50, both the susceptor 120 and the molten material 50 may be heated directly via the electromagnetic flux (depicted by electromagnetic flux envelope 130) of induction coil 26. Accordingly, each of the susceptor 120 and the molten material 50 may each exhibit its own skin depth $s_0$ and $d_0$, respectively.

One approach may be to predict the relative amount of power delivered within the susceptor 120 and the molten material 50 and then select a desired skin depth based on a weighted average of the respective skin depths, $s_0$ and $d_0$ thereof, respectively. For example, if the power is distributed 80% within the susceptor 120 and 20% within the molten material 50, and a desired skin depth for the susceptor 120 corresponds to an alternating current having a frequency of 1000 kHz and a desired skin depth for the molten material 50 corresponds to an alternating current having a frequency of 500 kHz, the weighted average thereof may be calculated by averaging 0.8 times 1000 kHz in addition to 0.2 times 500 kHz, which yields 900 kHz. Accordingly, a capacitance magnitude for producing an alternating current having a frequency of 900 Hz may be selected. As may be appreciated, there may be various mathematical approaches for maximizing the electrical efficiency between an induction coil 26 and two or more materials heated thereby, according to the present invention. Optionally, alternatively, or additionally, predictive modeling may be employed for selecting an alternating current that maximizes the electrical efficiency of induction heating of two or more materials by selection of a frequency of an alternating current within an inductor for heating thereof.

While the present invention has been described herein with respect to certain preferred embodiments, those of ordinary skill in the art will recognize and appreciate that it is not so limited. Rather, many additions, deletions and modifications to the preferred embodiments may be made without departing from the scope of the invention as hereinafter claimed. In addition, features from one embodiment may be combined with features of another embodiment while still being encompassed within the scope of the invention as contemplated by the inventors. Therefore, the invention is to cover all modifications, equivalents, and alternatives falling within the spirit and scope of the invention as defined by the following appended claims.

What is claimed is:

1. A method of operating a cold-crucible-induction melter, comprising:

providing a crucible having a wall disposed about a longitudinal axis and a bottom extending generally radially inwardly from the wall toward the longitudinal axis;

cooling the wall of the crucible;

providing at least one material within the crucible;

providing an inductor proximate the crucible and in operable communication with an induction heating circuit including a power source;

selecting a desired electromagnetic flux skin depth for inductively heating the at least one material within the crucible;

selecting an alternating current frequency for producing an electromagnetic flux exhibiting the desired electromagnetic flux skin depth within the at least one material;

energizing the inductor with the alternating current having the selected alternating current frequency; and adjusting the alternating current frequency after energizing the inductor to maintain the desired electromagnetic flux skin depth within the at least one material.

2. The method of claim 1, wherein selecting the desired electromagnetic flux skin depth comprises selecting the desired electromagnetic flux skin depth to be about 38% of a diameter of the at least one material.

3. The method of claim 1, further comprising substantially maintaining the desired electromagnetic flux skin depth within the at least one material as a temperature thereof varies.

4. The method of claim 1, further comprising melting the at least one material within the crucible to form a molten material substantially filling the crucible.

5. The method of claim 4, wherein selecting the desired electromagnetic flux skin depth comprises selecting the desired electromagnetic flux skin depth to be about 38% of a diameter of the molten material.

6. The method of claim 4, comprising heating the molten material, wherein an electrical resistance of the molten material changes in relation to a temperature thereof.

7. The method of claim 6, further comprising:

selecting another alternating current frequency for producing another electromagnetic flux exhibiting another desired electromagnetic flux skin depth within the at least one material; and energizing the inductor with an alternating current having the another selected alternating current frequency.

8. The method of claim 6, further comprising indicating the electrical resistance of the molten material.

9. The method of claim 8, further comprising:

modeling the induction heating circuit including the inductor, the molten material, and the power source; and calculating a desired electromagnetic flux skin depth via mathematical analysis of the modeling the induction heating circuit in combination with measuring at least one electrical characteristic of the induction heating circuit.

10. The method of claim 1, wherein selecting the alternating current frequency comprises selecting the alternating current frequency in response to a difference between the desired electromagnetic flux skin depth and an indicated electromagnetic flux skin depth of the electromagnetic flux within the at least one material.

11. The method of claim 10, wherein the selecting the alternating current frequency reduces the difference between the desired electromagnetic flux skin depth and the indicated electromagnetic flux skin depth of the electromagnetic flux within the at least one material.

12. The method of claim 10, wherein energizing the inductor comprises implementing a feedback control loop configured for energizing the inductor so as to minimize the difference between the desired electromagnetic flux skin depth and the indicated electromagnetic flux skin depth of the electromagnetic flux within the at least one material.

13. The method of claim 12, wherein energizing the inductor further comprises implementing another feedback control loop configured for selectively energizing the inductor.

14. The method of claim 13, wherein implementing the another feedback control loop configured for selectively energizing the inductor comprises implementing the another feedback control loop configured for energizing the inductor for a selected proportion of time and preventing the alternating current energizing the inductor for the remaining proportion of time.

15. The method of claim 12, wherein the feedback control loop implements a proportional, integral, and derivative type control algorithm.

16. The method of claim 12, further comprising using the feedback control loop for estimating a magnitude of the indicated electromagnetic flux skin depth of the electromagnetic flux within the at least one material.

17. The method of claim 16, wherein estimating the magnitude of the electromagnetic flux skin depth comprises calculating the magnitude of the electromagnetic flux skin depth via mathematical analysis of a model of the induction heating circuit in combination with at least one measurement of at least one electrical characteristic thereof.

18. The method of claim 1, wherein selecting the alternating current frequency comprises selecting a net capacitance magnitude for inclusion within the induction heating circuit.

19. The method of claim 18, wherein selecting the net capacitance magnitude for inclusion within the induction heating circuit comprises adjusting a capacitance magnitude of a variable capacitor.

20. The method of claim 18, wherein selecting the net capacitance magnitude for inclusion within the induction heating circuit comprises selecting one or more capacitors, wherein each of the one or more capacitors has a fixed capacitance magnitude.

21. The method of claim 18, wherein selecting the net capacitance magnitude for inclusion within the induction heating circuit comprises selecting a net capacitance based on a capacitance value calculated by the following equation:

$$C = 8.5 \cdot 10^{-19} \frac{D^4}{L} \frac{\mu^2}{\rho^2}.$$

22. The method of claim 1, wherein selecting the alternating current frequency for producing the electromagnetic flux having the desired electromagnetic flux skin depth within the at least one material comprises selecting an alternating current frequency for producing an electromagnetic flux having respective desired electromagnetic flux skin depths within each of more than one material.

23. The method of claim 22, wherein selecting the alternating current frequency for producing an electromagnetic flux having the respective desired electromagnetic flux skin depths within the each of the more than one material comprises selecting an alternating current frequency for producing an electromagnetic flux having a first desired electromagnetic flux skin depth within a susceptor and a second desired electromagnetic flux skin depth within a molten material.

24. A method of operating a cold-crucible-induction melter, comprising:

providing a crucible having a wall disposed about a longitudinal axis and a bottom extending generally radially inwardly from the wall toward the longitudinal axis;

cooling the wall of the crucible;

providing at least one material within the crucible;

providing an inductor proximate the crucible and in operable communication with an induction heating circuit including a power source; and inductively heating the at least one material while substantially maintaining a desired electromagnetic flux skin depth as the at least one material increases in temperature.

25. The method of claim 24, wherein substantially maintaining the desired electromagnetic flux skin depth as the at least one material increases in temperature comprises substantially maintaining the desired electromagnetic flux skin depth at about 38% of a diameter of the at least one material.

26. A method of operating a cold-crucible-induction melter, comprising:

providing a crucible having a wall disposed about a longitudinal axis and a bottom extending generally radially inwardly therefrom;

cooling the wall of the crucible;

providing a molten material substantially filling the crucible;

providing an inductor proximate the crucible and in operable communication with an induction heating circuit including a power source; and substantially maintaining a desired electromagnetic flux skin depth within the molten material, upon energizing the inductor, as the temperature of the molten material varies.

27. The method of claim 26, wherein substantially maintaining the desired electromagnetic flux skin depth as the molten material varies in temperature comprises substantially maintaining the desired electromagnetic flux skin depth at about 38% of a diameter of the molten material.

28. The method of claim 26, wherein substantially maintaining the desired electromagnetic flux skin depth as the molten material varies in temperature comprises substantially maintaining the desired electromagnetic flux skin depth while maintaining a substantially constant temperature of the molten material.

29. An induction heating apparatus, comprising:

a crucible;

a cooling structure disposed about the crucible for cooling thereof;

an inductor disposed proximate the crucible;

a variable-frequency power supply having an electrical output operably coupled to the inductor and configured for delivering an alternating current therethrough;

a sensor configured to detect changes in at least one physical characteristic of an anticipated at least one material positioned within the crucible; and a controller configured for selectively varying a frequency of the alternating current at least partially in response to chances in the at least one physical characteristic to be detected by the sensor to produce an electromagnetic flux exhibiting a desired electromagnetic flux skin depth within the anticipated at least one material.

30. The induction heating apparatus of claim 29, wherein the controller is configured for maintaining the selected electromagnetic flux skin depth within the anticipated at least one material, upon energizing the inductor, as the temperature of the anticipated at least one material varies.

31. The induction heating apparatus of claim 29, further comprising at least one variable capacitor electrically coupled to the inductor and having a magnitude of capacitance that is selectable via the controller.

32. The induction heating apparatus of claim 31, wherein the controller is configured for selecting a net capacitance magnitude operably coupled to the inductor and based on a capacitance value calculated by the following equation:

$$C = 8.5 \cdot 10^{-19} \frac{D^4}{L} \frac{\mu^2}{\rho^2}.$$

33. The induction heating apparatus of claim 29, further comprising a plurality of capacitors wherein each of the plurality of capacitors is configured to be individually and reversibly electrically coupled to the inductor via the controller.

34. The induction heating apparatus of claim 33, wherein the controller is configured for selecting a net capacitance magnitude operably coupled to the inductor and based on a capacitance value calculated by the following equation:

$$C = 8.5 \cdot 10^{-19} \frac{D^4}{L} \frac{\mu^2}{\rho^2}.$$

35. The induction heating apparatus of claim 29, further comprising a susceptor configured for heating the anticipated at least one material, when positioned within the crucible by contact therewith, wherein the susceptor is sized and configured for inductive heating by way of energizing the inductor.

36. The induction heating apparatus of claim 29, wherein the controller includes a heating feedback control loop and a skin depth feedback control loop.

37. The induction heating apparatus of claim 36, further comprising a temperature measurement device operably coupled to the controller and configured for measuring the temperature of the anticipated at least one material.

* * * * *